US006571966B1

(12) United States Patent
Hsiao

(10) Patent No.: US 6,571,966 B1
(45) Date of Patent: Jun. 3, 2003

(54) MAGNETIC STORAGE RACK HAVING U-SHAPED RETAINERS AND TOOL-HOLDING SEAT

(76) Inventor: Chieh-Jen Hsiao, 2F, No. 215, Yu-Te Rd., Pei Dist., Taichung City (TW)

( * ) Notice: Subject to any disclaimer, the term of this patent is extended or adjusted under 35 U.S.C. 154(b) by 0 days.

(21) Appl. No.: 10/101,599

(22) Filed: Mar. 21, 2002

(51) Int. Cl.[7] ..... A47F 7/00
(52) U.S. Cl. ..... 211/70.6; 211/69; 206/379
(58) Field of Search ..... 211/70.6, 94.01, 211/89.01, 69, 106; 206/379, 350; 248/111, 206.5, 314

(56) References Cited

U.S. PATENT DOCUMENTS 2,591,805 A * 4/1952 Gossett ..... 211/89.01
4,497,412 A * 2/1985 Labelle ..... 211/70.7
4,771,897 A * 9/1988 Ho ..... 211/85.9
4,899,974 A * 2/1990 Wear et al. ..... 248/467
5,570,794 A * 11/1996 Drower ..... 211/89.01
5,711,435 A * 1/1998 Morison et al. ..... 211/90.01
5,768,966 A * 6/1998 Duginske ..... 83/468.7
5,779,066 A * 7/1998 Drower et al. ..... 211/89.01
5,794,795 A * 8/1998 Stemmons ..... 211/26
5,915,573 A * 6/1999 Drower et al. ..... 211/89.01
5,992,626 A * 11/1999 Anderson ..... 206/378
6,065,598 A * 5/2000 Anderson ..... 206/378
6,352,229 B1 * 3/2002 Adams ..... 248/316.7

* cited by examiner

*Primary Examiner*—Daniel P. Stodola
*Assistant Examiner*—Khoa Tran
(74) *Attorney, Agent, or Firm*—Nixon & Vanderhye P.C.

(57) ABSTRACT

A storage rack includes a casing having opposite front and rear walls, a bottom wall, and a partition plate interconnecting and cooperating with the front and rear walls to define a seat-receiving channel above the partition plate and with the bottom wall to define a retainer-receiving channel below the partition plate. The front wall has a lower section defining an elongated opening in spatial communication with the retainer-receiving channel. A tool-holding seat is removably disposed in the seat-receiving channel, and has a plurality of bit-retention holes extending inwardly from a flat top face thereof for holding tool pieces therein. A plurality of U-shaped retainers are mounted on the lower section of the front wall along the length of the elongated opening, and abut against one another so that each adjacent pair of the retainers can clamp a tool piece therebetween.

4 Claims, 5 Drawing Sheets

MAGNETIC STORAGE RACK HAVING U-SHAPED RETAINERS AND TOOL-HOLDING SEAT

BACKGROUND OF THE INVENTION

1. Field of the Invention

This invention relates to a storage rack, more particularly to a magnetic storage rack having U-shaped retainers and a tool-holding seat for retention of tool pieces of different configurations and dimensions.

2. Description of the Related Art

Referring to FIG. 1, a conventional storage rack 1 is shown to include an elongated casing 100 having opposite front and rear walls defining a retainer-receiving channel 101 therebetween. The front wall defines an elongated opening 102 that extends along the length of the casing 100, and that is in spatial communication with the retainer-receiving channel 101. A plurality of U-shaped retainers 2 are mounted on the front wall along the length of the elongated opening 102 and abut against one another so that each adjacent pair of the retainers 2 is adapted to clamp a tool piece 3, such a paint brush, therebetween.

FIG. 2 shows a conventional storage seat 300 which includes an elongated seat body 7 defining a plurality of parallel spaced apart bit-retention holes 701 which extend inwardly from a flat top face of the seat body 7 and which are capable of retaining workpiece-driving bits 9 therein, respectively. A magnet piece 8 is fixed to a flat bottom face of the seat body 7 so as to permit magnetic attachment of the tool-holding seat 300 on a flat surface of a working site.

It is inconvenient to store and carry both the storage rack and the storage seat.

SUMMARY OF THE INVENTION

The main object of this invention is to provide a magnetic storage rack which has U-shaped retainers and a tool-holding seat for retention of tool pieces of different configurations and dimensions, thereby overcoming the aforementioned drawback.

Accordingly, a storage rack of the present invention includes an elongated casing, a series of U-shaped retainers, left and right end covers, a tool-holding seat, and a magnetic member. The casing has a top open end, left and right open ends, opposite front and rear walls extending between the left and right open ends, a bottom wall interconnecting the front and rear walls and extending between the left and right open ends, and a partition plate interconnecting the front and rear walls at a position between the top open end and the bottom wall, extending between the left and right open ends, and cooperating with the front and rear walls to define a seat-receiving channel which is located above the partition plate and which extends between the left and right open ends, and with the bottom wall and the front and rear walls to define a retainer-receiving channel which is located below the partition plate and which extends between the left and right open ends. The front wall has an upper section confining a front side of the seat-receiving channel, and a lower section that confines a front side of the retainer-receiving channel and that has an elongated opening extending between the left and right open ends of the elongated casing and in spatial communication with the retainer-receiving channel. The retainers are mounted on the lower section of the front wall along the length of the elongated opening, and abut against one another so that each adjacent pair of the retainers is adapted to clamp a first tool piece therebetween. Each of the retainers includes a bight portion exposed outwardly of the retainer-receiving channel, and two legs that extend from the bight portion and that have anchored ends which extend through the elongated opening and into the retainer-receiving channel and which are anchored thereto. The end covers respectively close portions of the left and right open ends of the elongated casing which extend between the partition plate and the bottom wall so as to prevent removal of the retainers from the left and right open ends. The end covers abut against adjacent ones of the retainers so as to urge adjacent ones of the retainers to abut against each other. The tool-holding seat is slidably mounted in the seat-receiving channel, and is removable therefrom via the left and right open ends. The tool-holding seat has opposite flat bottom and top faces, and is formed with a plurality of parallel spaced apart bit-retention holes that extend inwardly from the flat top face. Each of the bit-retention holes is adapted to retain a second tool piece therein. The magnetic member is fixed to the rear wall of the elongated casing such that the storage rack can be mounted on a wall by virtue of magnetic attraction.

BRIEF DESCRIPTION OF THE DRAWINGS

These and other features and advantages of this invention will become apparent in the following detailed description of the preferred embodiment of this invention, with reference to the accompanying drawings, in which.

DETAILED DESCRIPTION OF THE PREFERRED EMBODIMENT

Figure 1:
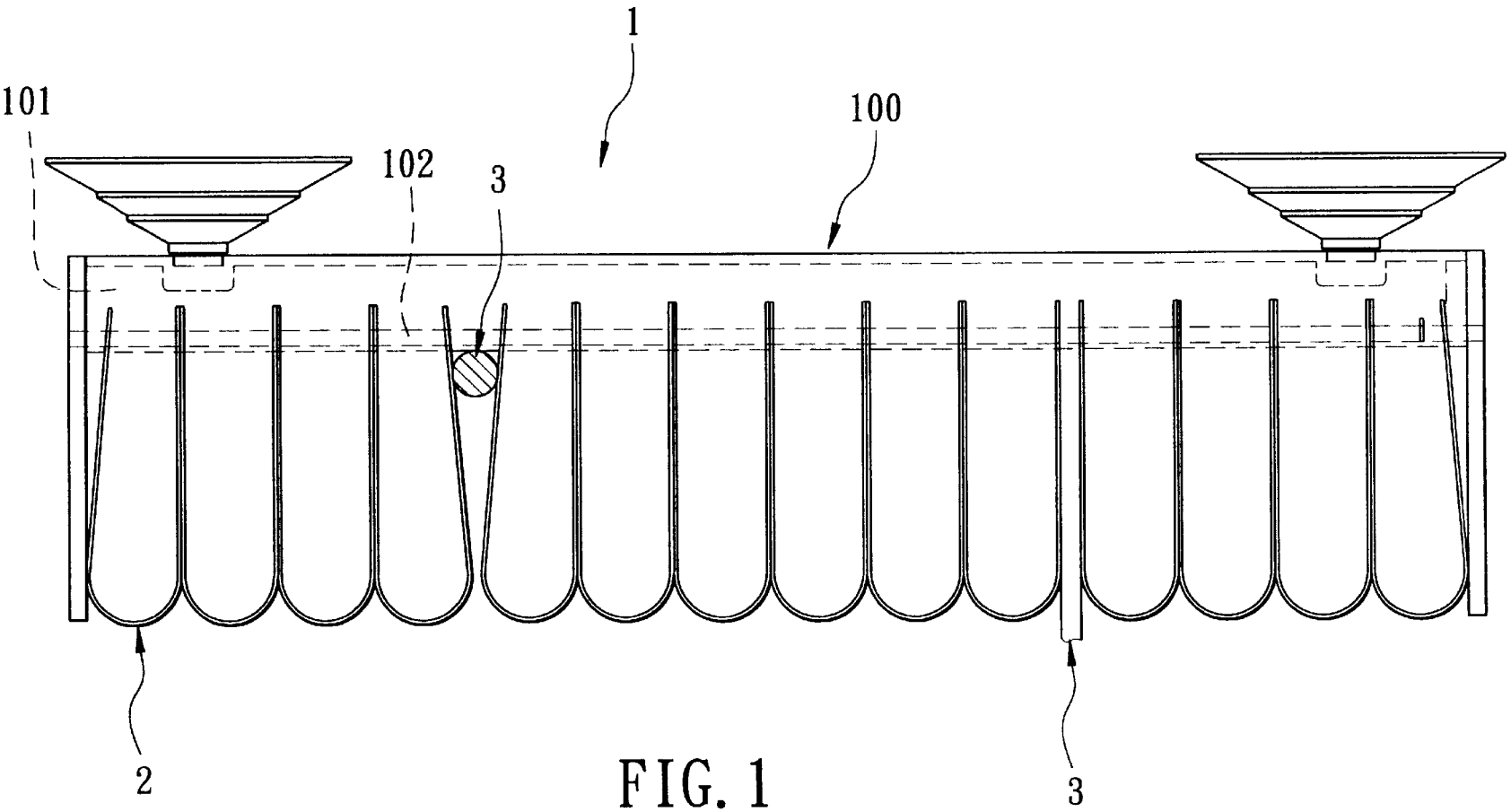
FIG. 1 PRIOR ART
FIG. 1 is a schematic top planar view of a conventional storage rack for holding tool pieces between adjacent pairs of U-shaped retainers.
Figure 2:
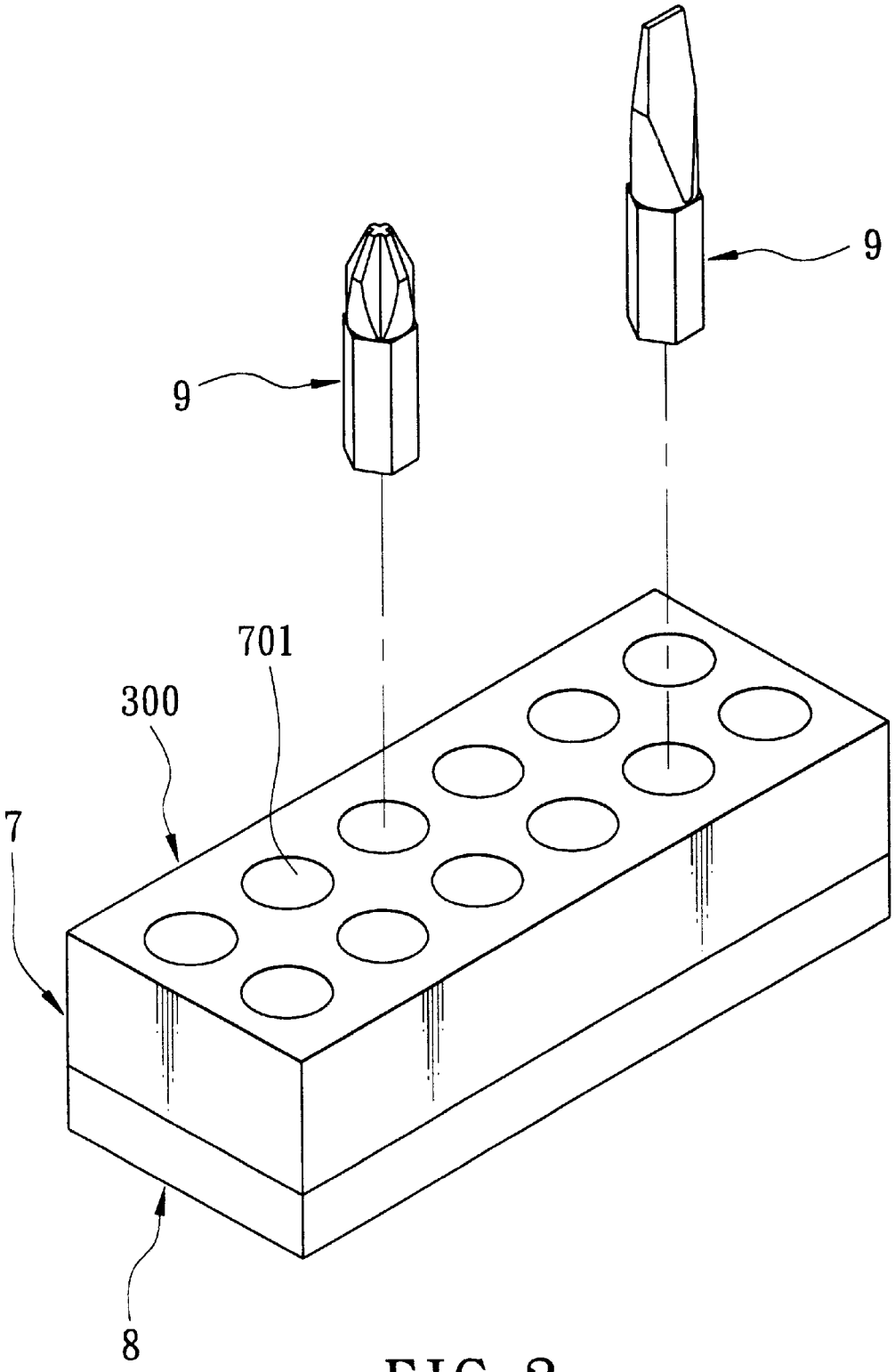
FIG. 2 PRIOR ART
FIG. 2 is a perspective view of a conventional storage seat shown together with tool pieces of different configurations.
Figure 3:
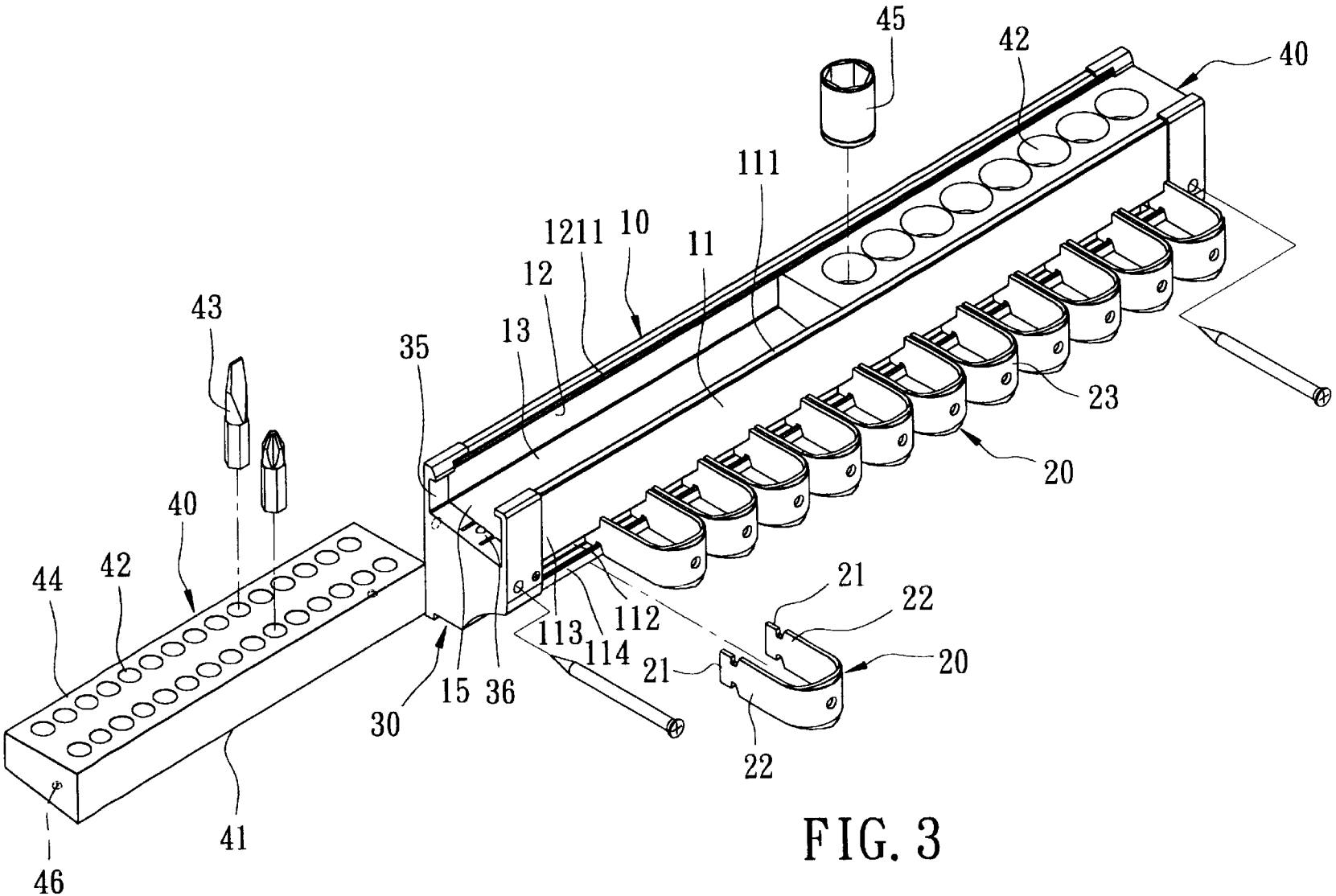
FIG. 3 is a perspective partly exploded view of a preferred embodiment of a storage rack according to the present invention.
Figure 4:
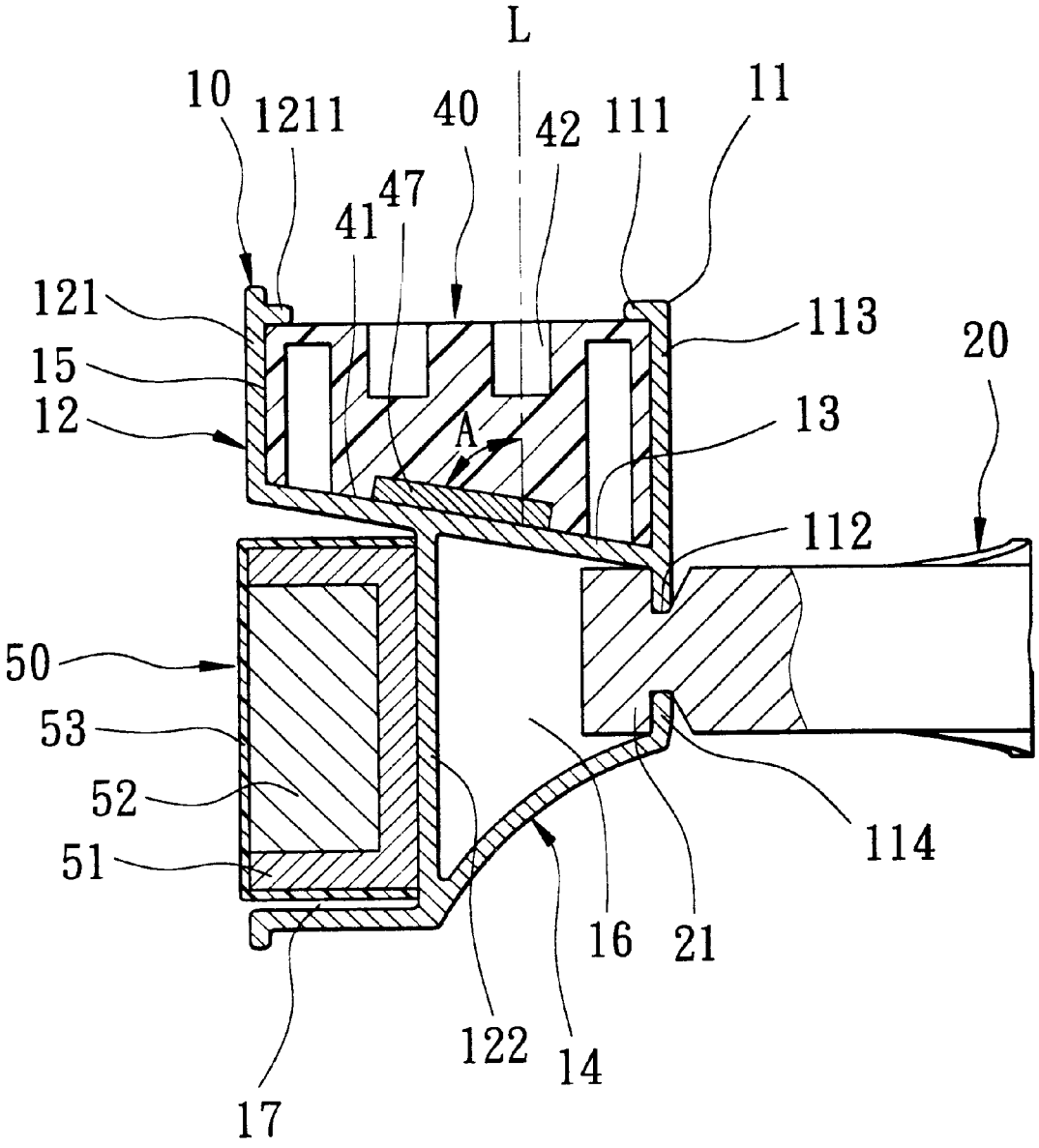
FIG. 4 is a sectional view of the preferred embodiment, illustrating how a plurality of U-shaped retainers and a tool-holding seat are mounted thereon for holding tool pieces of different configurations and dimensions.
Figure 5:
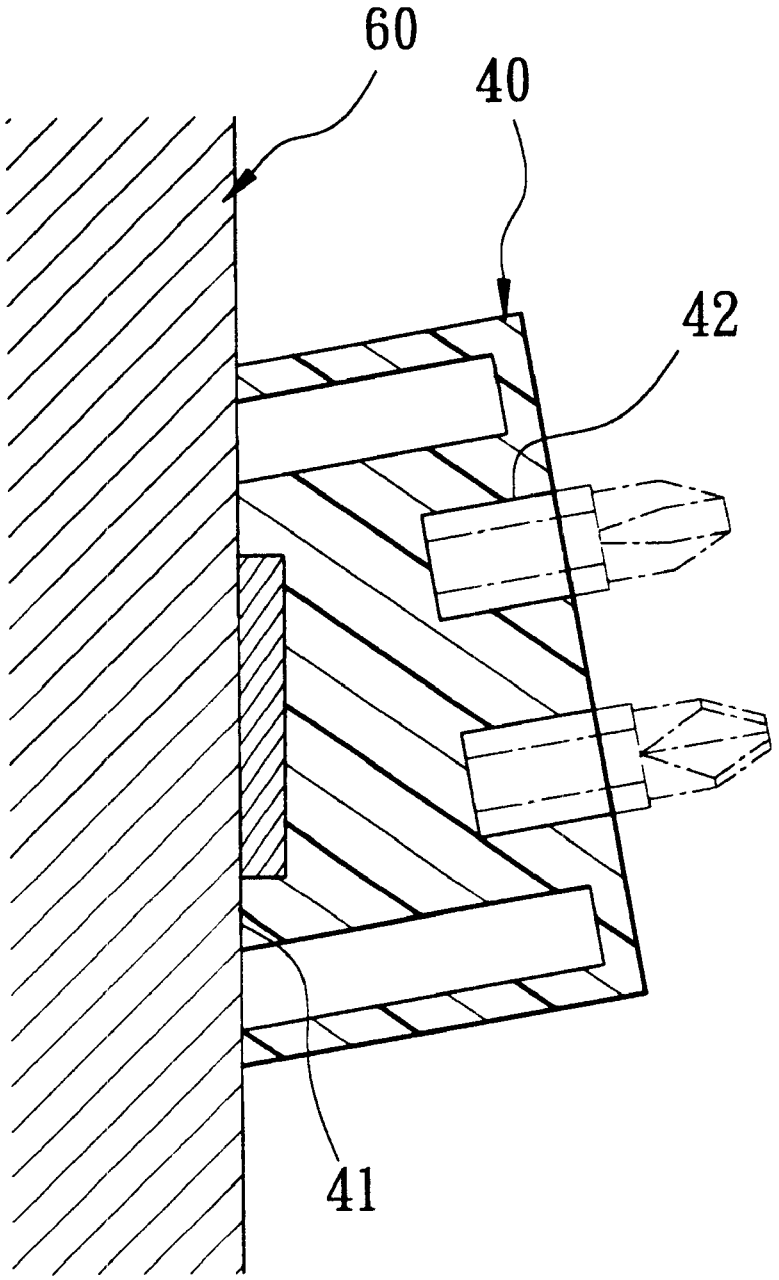
FIG. 5 illustrates the tool-holding seat in a state of use after removal from the storage rack of the present invention.

Referring to FIGS. 3, 4 and 5, the preferred embodiment of a storage rack according to the present invention is shown to include a plastic elongated casing 10, a series of U-shaped retainers 20, left and right end covers 30, a tool-holding seat 40, and a magnetic member 50.

As illustrated, the elongated casing 10 has a top open end, left and right open ends, opposite front and rear walls 11, 12 extending between the left and right open ends, a bottom wall 14 interconnecting the front and rear walls 11, 12 and extending between the left and right open ends, and a partition plate 13 interconnecting the front and rear walls 11, 12 at a position between the top open end and the bottom wall 14. The partition plate 13 extends between the left and right open ends of the elongated casing 10, and cooperates with the front and rear walls 11, 12 to define a seat-receiving channel 15 which is located above the partition plate 13 and which extends between the left and right open ends of the elongated casing 10, and with the bottom wall 14 and the front and rear walls 11, 12 to define a retainer-receiving channel 16 which is located below the partition plate 13 and which extends between the left and right open ends of the elongated casing 10. The front wall 11 has an upper section 113 confining a front side of the seat-receiving channel 15, and a lower section 114 confining a front side of the retainer-receiving channel 16. The lower section 114 of the front wall 11 has an elongated opening 112 extending between the left and right open ends of the elongated casing 10. The elongated opening 112 is in spatial communication with the retainer-receiving channel 16.

The U-shaped retainers 20 are mounted on the lower section 114 of the front wall 11 along the length of the elongated opening 112, and abut against one another so that each adjacent pair of the retainers 20 is adapted to clamp a first tool piece, such as a paint brush, therebetween. Each of the retainers 20 includes a bight portion 23 exposed outwardly of the retainer-receiving channel 16, and two legs 22 that extend from the bight portion 23 and that have anchored ends 21 which extend through the elongated opening 112 and into and anchored to the retainer-receiving channel 16 and which are anchored thereto.

The left and right end covers 30 respectively close portions of the left and right open ends of the elongated casing 10 which extend between the partition plate 13 and the bottom wall 14 so as to prevent removal of the retainers 20 from the left and right open ends of the elongated casing 10. Under this condition, the end covers 30 abut against adjacent ones of the retainers 20 so as to urge adjacent ones of the retainers 20 to abut against each other.

The tool-holding seat 40 is slidably mounted in the seat-receiving channel 15 and is removable therefrom via the left and right open ends of the elongated casing 10. The tool-holding seat 40 has opposite flat bottom and top faces 41, 44, and is formed with a plurality of parallel spaced apart bit-retention holes 42 extending inwardly from the flat top face 44. Each of the bit-retention holes 42 is adapted to retain a second tool piece therein, such as a workpiece-driving bit 43 or a socket 45.

The magnetic member 50 is fixed to the rear wall 12 of the elongated casing 10 such that the storage rack can be mounted on a wall by virtue of magnetic attraction.

In this embodiment, the rear wall 12 has an upper section 121 which confines a rear side of the seat-receiving channel 15, and a lower section 122 that extends downwardly from the partition plate 13 at a position between the upper sections 113, 121 of the front and rear walls 11, 12 to the bottom wall 14 so as to confine a rear side of the retainer-receiving channel 16. The partition plate 13, the lower section 122 of the rear wall 12, and the bottom wall 14 cooperatively define the retainer-receiving channel 16 and a magnet-receiving chamber 17 within which the magnetic member 50 is disposed non-removably. Under this condition, the magnet-receiving chamber 17 is located below the seat-receiving channel 15 and rearwardly of the retainer-receiving channel 16.

Preferably, the partition plate 13 extends and inclines downwardly and frontwardly from the upper section 121 of the rear wall 12 toward the upper section 113 of the front wall 11. The flat bottom face 41 of the tool-holding seat 40 is inclined relative to the upper sections 113, 121 of the front and rear walls 11, 12 to complement the partition plate 13. The flat top face 44 of the tool-holding seat 40 is perpendicular to the upper sections 113, 121 of the front and rear walls 11, 12. Each of the bit-retention holes 42 in the tool-holding seat 40 defines an axial line L along the length thereof. The axial line (L) of each of the retention holes 42 is inclined relative to the flat bottom face 41 of the tool-holding seat 40 at an acute angle (A) (see FIG. 4) so as to facilitate insertion of and access to the second tool piece 43 in the bit-retention hole 42. A magnetic piece 47 is embedded in the tool-holding seat 40, and is adjacent to and flush with the flat bottom face 41 of the tool-holding seat 40 so that the tool-holding seat 40 can be mounted on a wall 60 by virtue of magnetic attraction, as best shown in FIG. 5, upon removal of the tool-holding seat 40 from the seat-receiving channel 15 via the left and right open ends. Under this condition, the tool pieces will not fall out from the bit-retention holes 42 by virtue of inclination of the flat top face 44 relative to the flat bottom face 41.

The preferred embodiment further includes left and right U-shaped end-confining frames 35 which are integrally formed with and extend upwardly from upper portions of the left and right end covers 30 and extend upward from and which are sleeved on the upper sections 113, 121 of the front and rear walls 11, 12. A groove-and-tongue engagement unit 36, 46 interconnects the bottom face 41 of the tool-holding seat 40 and the U-shaped end-confining frames 35 to prevent untimely removal of the tool-holding seat 40 from the seat-receiving channel 15.

Preferably, the upper sections 113, 121 of the front and rear walls 11, 12 have L-shaped top ends 111, 1211 that project toward each other so as to prevent upward removal of the tool-holding seat 40 from the seat-receiving channel 15 via the top open end of the The magnetic member 50 preferably includes a U-shaped metal frame 51, a magnet piece 52 disposed in the frame 51, and a U-shaped plastic sheath 53 which encloses the frame 51 and the magnet piece 52 therein, which is connected to the lower section 122 of the rear wall 12, and which is generally flush with the upper section 121 of the rear wall 12 to facilitate mounting of the storage rack of the present invention on a wall by virtue of magnetic attraction.

With this invention thus explained, it is apparent that numerous modifications and variations can be made without departing from the scope and spirit of this invention. It is therefore intended that this invention be limited only as indicated by the appended claims.

I claim:

1. A storage rack comprising:

an elongated casing having a top open end, left and right open ends, opposite front and rear walls extending between said left and right open ends, a bottom wall interconnecting said front and rear walls and extending between said left and right open ends, and a partition plate interconnecting said front and rear walls at a position between said top open end and said bottom wall, extending between said left and right open ends, and cooperating with said front and rear walls to define a seat-receiving channel which is located above said partition plate and which extends between said left and right open ends, and with said bottom wall and said front and rear walls to define a retainer-receiving channel which is located below said partition plate and which extends between said left and right open ends, said front wall having an upper section confining a front side of said seat-receiving channel, and a lower section confining a front side of said retainer-receiving channel and having an elongated opening extending between said left and right open ends of said elongated casing and in spatial communication with said retainer-receiving channel;

a series of U-shaped retainers mounted on said lower section of said front wall along the length of said elongated opening and abutting against one another so that adjacent pair of said retainers is adapted to clamp a first tool piece therebetween, each of said retainers including a bight portion exposed outwardly of said retainer-receiving channel, and two legs that extend from said bight portion and that have anchored ends which extend through said elongated opening and into said retainer-receiving channel and which are anchored thereto;

a pair of left and right end covers respectively closing portions of said left and right open ends of said elongated casing which extend between said partition plate and said bottom wall so as to prevent removal of said retainers from said left and right open ends, said left and right end covers abutting against adjacent ones of said retainers so as to urge adjacent ones of said retainers to abut against each other;

a tool-holding seat slidably mounted in said seat-receiving channel and removable therefrom via said left and right open ends, said tool-holding seat having opposite flat bottom and top faces, and being formed with a plurality of parallel spaced apart bit-retention holes that extend inwardly from said flat top face, each of said bit-retention holes being adapted to retain a second tool piece therein; and a magnetic member fixed to said rear wall of said elongated casing such that said storage rack can be mounted on a wall by virtue of magnetic attraction.

2. The storage rack as defined in claim 1, wherein said rear wall has an upper section which confines a rear side of said seat-receiving channel, and a lower section that extends downwardly from said partition plate at a position between said upper sections of said front and rear walls to said bottom wall to confine a rear side of said retainer-receiving channel, said partition plate, said lower section of said rear wall, and said bottom wall cooperatively defining said retainer-receiving channel and a magnet-receiving chamber thereamong to receive said magnetic member therein, said magnet-receiving chamber being located below said seat-receiving channel and rearwardly of said retainer-receiving channel.

3. The storage rack as defined in claim 2, wherein said partition plate extends and inclines downwardly and frontwardly from said upper section of said rear wall toward said upper section of said front wall, said flat bottom face of said tool-holding seat being inclined relative to said upper sections of said front and rear walls to complement said partition plate, said flat top face of said tool-holding seat being perpendicular to said upper sections of said front and rear walls, said storage rack further comprising a magnetic piece embedded in said tool-holding seat adjacent to said flat bottom face of said tool-holding seat so that, upon removal of said tool-holding seat from said seat-receiving channel via said left and right open ends, said tool-holding seat can be mounted on a wall by virtue of magnetic attraction.

4. The storage rack as defined in claim 3, wherein each of said bit-retention holes in said tool-holding seat defines an axial line along the length thereof, said axial line of each of said bit-retention holes being inclined relative to said flat bottom face of said tool-holding seat at an acute angle so as to facilitate insertion of and access to the second tool piece in said bit-retention hole.

* * * * *